US006003176A

United States Patent [19]

Wasley et al.

[11] Patent Number: 6,003,176

[45] Date of Patent: Dec. 21, 1999

[54] UNIVERSAL LATERAL POSITIONER

[75] Inventors: Alan A. Wasley, Southington; James R. Bailey, Plainville, both of Conn.; G. David Ritland, Washington, D.C.

[73] Assignee: Imp. Inc., Plainville, Conn.

[21] Appl. No.: 09/084,278

[22] Filed: May 26, 1998

[51] Int. Cl.[6] ..... A47B 7/00

[52] U.S. Cl. ..... 5/624; 5/621; 128/845

[58] Field of Search ..... 5/624, 600, 621, 5/632, 648, 603; 128/845

[56] References Cited

U.S. PATENT DOCUMENTS 4,866,796 9/1989 Robinson et al. ..... 5/607

5,390,383 2/1995 Carn ..... 5/624

*Primary Examiner*—Terry Lee Melius

*Assistant Examiner*—James M. Hewitt

[57] ABSTRACT

A hyperflexion plate in the form of a hexagonal plate having a rail extending from the bottom surface of the plate for insertion within the track formed in a universal hip support plate for supporting a patient in the lateral decubitus position for surgery of the hip. The hyperflexion plate allows positioning of the anterior support at an angle substantially larger than the limited angle defined by the track formed in the universal hip support plate.

16 Claims, 6 Drawing Sheets

UNIVERSAL LATERAL POSITIONER

BACKGROUND OF THE INVENTION

Medical apparatus for securing a patient in the lateral decubitus position during surgery of the hip are currently available. U.S. Pat. No. 3,844,550 entitled "Pelvic Support for Surgical Operations" describes one such support that is secured to an operating table or the like. The support includes a pair of anterior and posterior support braces for supporting a patient securely in the lateral decubitus position for surgeries of the hip. The anterior and posterior support braces are mounted on a support plate that allows the movement of the braces in the horizontal plane to compensate for the size and structure of the specific patient.

In surgical procedures such as hip arthroplasty and hip fracture, it is sometimes necessary to flex the hip beyond 90 degrees to check range of motion and stability of the hip joint. In a dislocation of the hip it is also necessary to flex the hip flex the hip beyond 90 degrees to reduce the dislocation. The unidirectional movement of the support plate described within the aforementioned U.S. Pat. No. 3,844,550 does not readily allow flexion of the hip beyond a limited angle of 90 degrees.

It would be desirable to utilize such a support plate for hip surgery and adapt the support plate for extended flexion of the hip when surgical hyperflexion procedures are required.

Accordingly, one purpose of the invention is to describe a hyperflexion plate that is readily adapted to pre-existing hip surgery support plates to allow the flexion required in such surgical procedures without requiring replacement or substantial modification to the existing support plate.

SUMMARY OF THE INVENTION

A hyperflexion plate in the form of a hexagonal plate having a rail extending from the bottom surface of the plate for insertion within the track formed in the hip support plate. A pair of slots extending at an angle to the rail alternately receive the anterior support brace for providing displacement of the anterior support plate at an angle substantially larger than the limited angle defined by the track formed in the hip support plate. A threaded knob accessible from the top of the hyperflexion plate extends from the bottom thereof for attachment between the hyperflexion plate and the hip support plate.

DESCRIPTION OF THE PREFERRED EMBODIMENT

Figure 1:
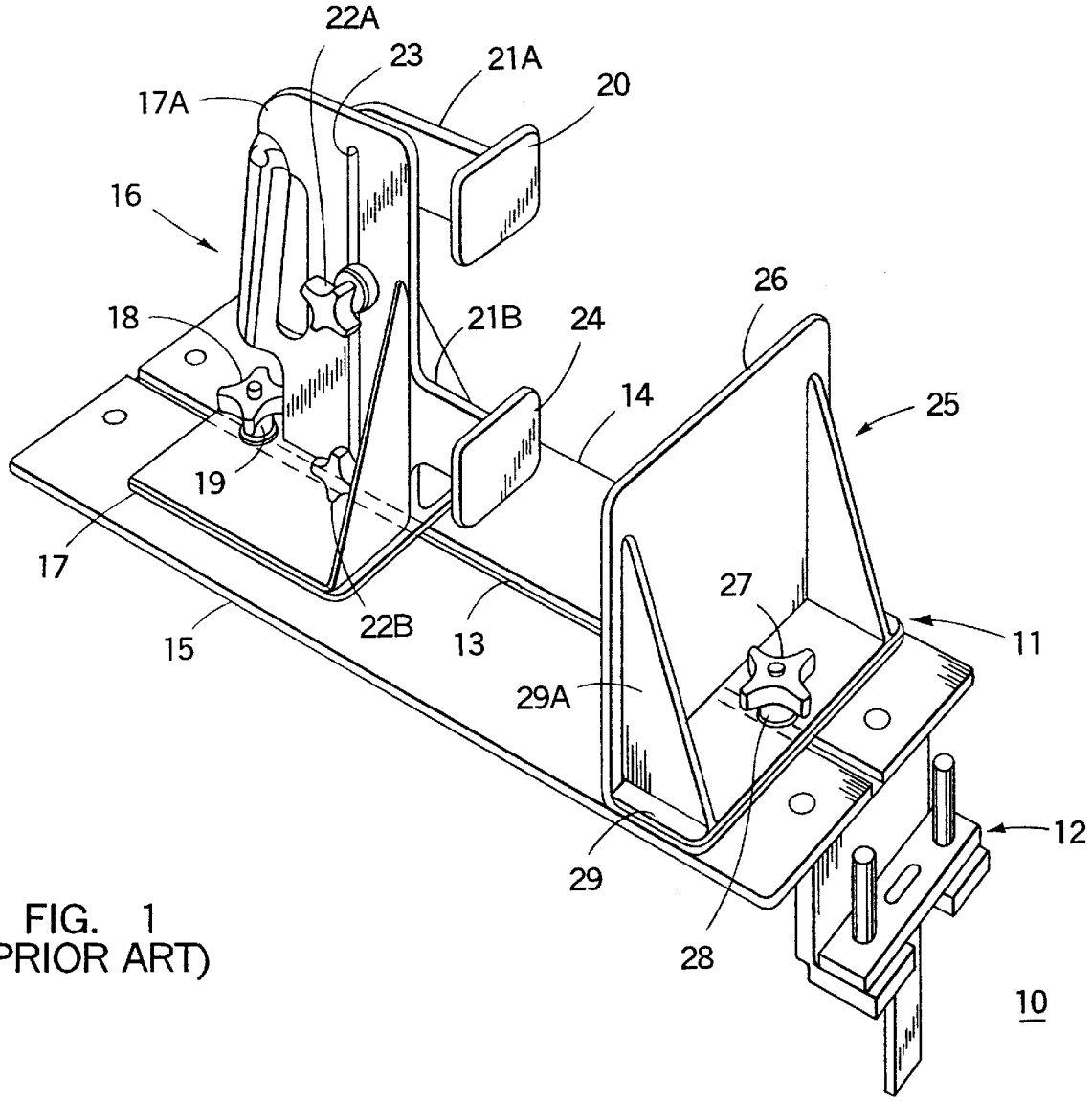
FIG. 1 (PRIOR ART)
FIG. 1 is a top perspective view of a universal lateral positioner according to the Prior Art.

Before describing the advantages of the hyperflexion plate according to the invention, it is helpful to review the operation of the universal lateral positioner described within the aforementioned U.S. Pat. No. 3,844,550. As shown in FIG. 1, the positioner 10 is in the form of a support plate 11 made of an aluminum composition. The plate 11 is attached to an operating table, or the like, by means of a T-shaped fastener 12 arranged at one end. An elongated slot in the form of a track 13 , intermediate the sides 14, 15, extends along the major dimension of the plate 11 and serves to movably support the anterior or front support 16 as well as the posterior or back support indicated at 25.

The anterior support 16 includes a front plate 17 on the bottom thereof that is movably attached to the track 13 by means of the threaded stem 19 extending from the knob 18. The vertical extension 17A formed on the anterior plate 17 serves to support first and second anterior pressure plates 20, 24 that provide the support function described in detail within the aforementioned U.S. Pat. No. 3,844,550. The height of the first anterior pressure plates can be adjusted by means of the arms 21A, 21B that attach to the vertical extension 17A by means of slot 23 and threaded knobs 22A, 22B. The posterior support 25 includes a posterior plate 29 on the bottom thereof that is movably attached to the track 13 by means of the threaded stem 28 extending from the knob 27. The vertical extension 29A formed on the posterior plate 29 serves to support the posterior pressure plate 26 that provide the support function as described within the aforementioned U.S. Pat. No. 3,844,550.

Figure 2:
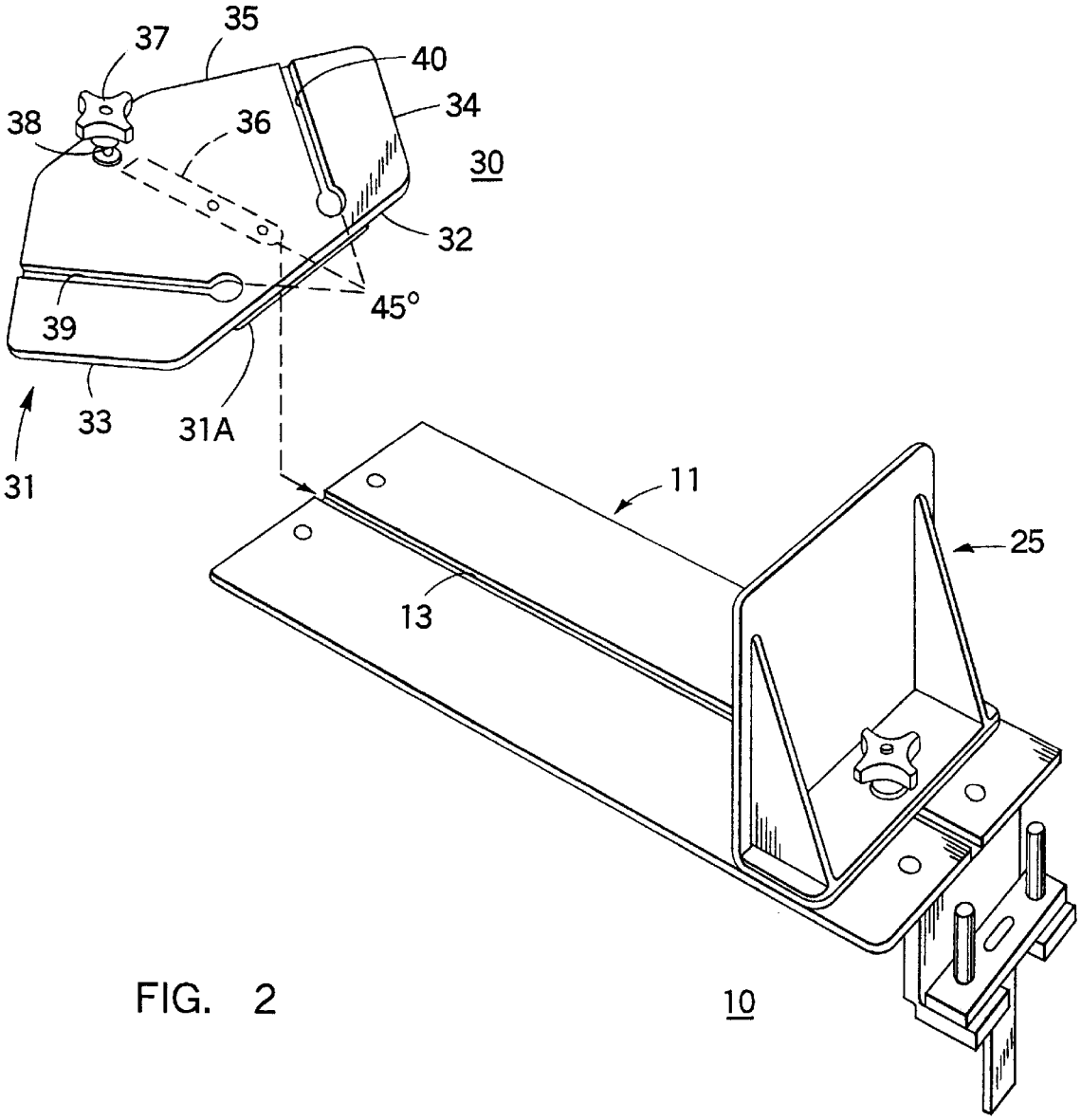
FIG. 2 is a top perspective view of the hyperflexion plate in accordance with the invention in isometric projection to the universal lateral positioner of FIG. 1.
Figure 3:
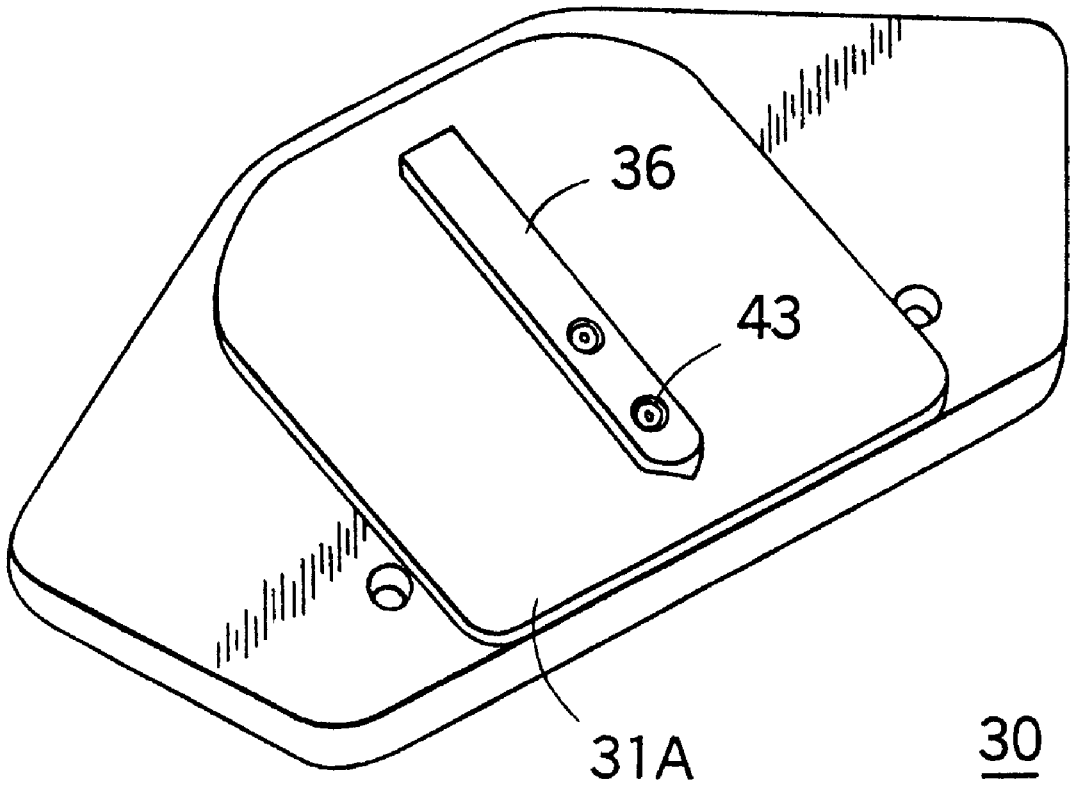
FIG. 3 is a bottom perspective view of the hyperflexion plate of FIG. 2.

In accordance with the invention, a hyperflexion plate 30 is shown in Oils FIG. 2 in the form of a hexagonal plate 31 made of aluminum that includes a layer 31 A of Delrin on the bottom surface thereof along with a downwardly-extending rail 36 that is received in the track 13 on the support plate 11 shown earlier in FIG. 1 that carries the posterior support plate 25 and is attached to the track by means of the threaded stem 38 and knob 37. Delrin is a trade name of DuPont Inc. for an acetal homopolymer that can withstand sterilization treatment. The plate 31 includes opposing front and rear edges 32, 35 and opposing sides 33, 34 with a pair of additional tracks 39, 40 parallel with the sides 33, 34. The tracks 39, 40 are arranged at an angle equal to or greater than 45° relative to the rail 36 to allow positioning of the anterior pressure plates 20, 24 and posterior pressure plate 26 of FIG. 1 at a greater angle relative to the body of a patient as will be described below in some detail. The rear surface of the hyperflexion plate 30 is shown in FIG. 3 to include the Dehrin plate 31A to which the rail 36 is attached by screws, as indicated at 43.As now shown in FIG. 4, the hyperflexion plate 30 is first attached to the rail 13 on the support plate 11 of the universal lateral positioner 10 by means of the knob 37 to allow translation of the hyperflexion plate along the support plate. This now allows attachment of the anterior support assembly 16 to either of the two rails 39, 40 by insertion of the track 41 on the bottom surface of the anterior plate 17, within one of the two rails and tightening the knob 18. With the posterior support plate 25 in position on the support plate 11, this then allows the wide positioning of the anterior pressure plates 20, 24 relative to the posterior pressure plate 26 on the opposite 40 end of the support plate 11.

Figure 4:
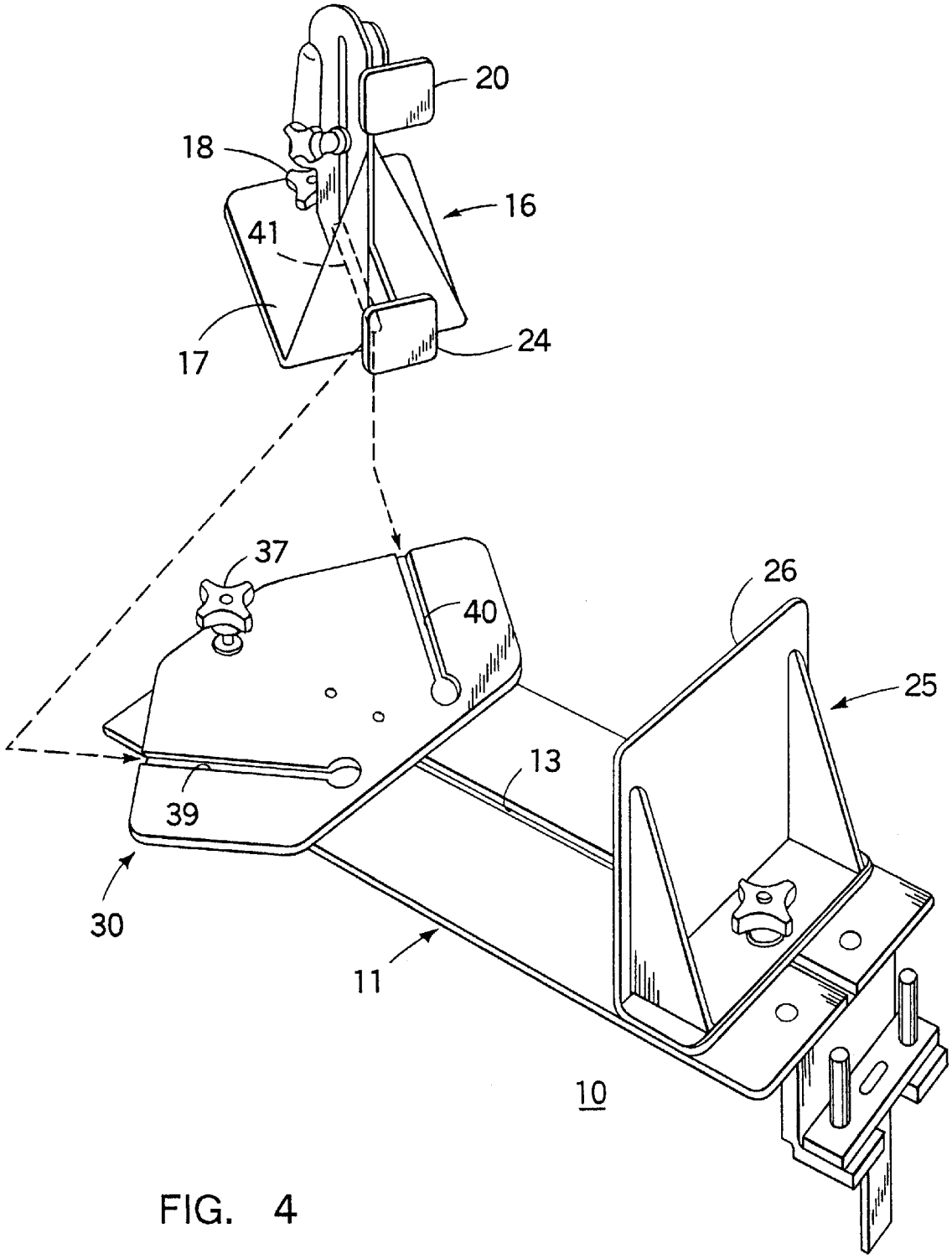
FIG. 4 is a top perspective view of the hyperflexion plate attached to the universal lateral positioner of FIG. 1 with the anterior support plate of the universal lateral positioner of FIG. 1 in isometric projection to the attached hyperflexion plate.
Figure 5:
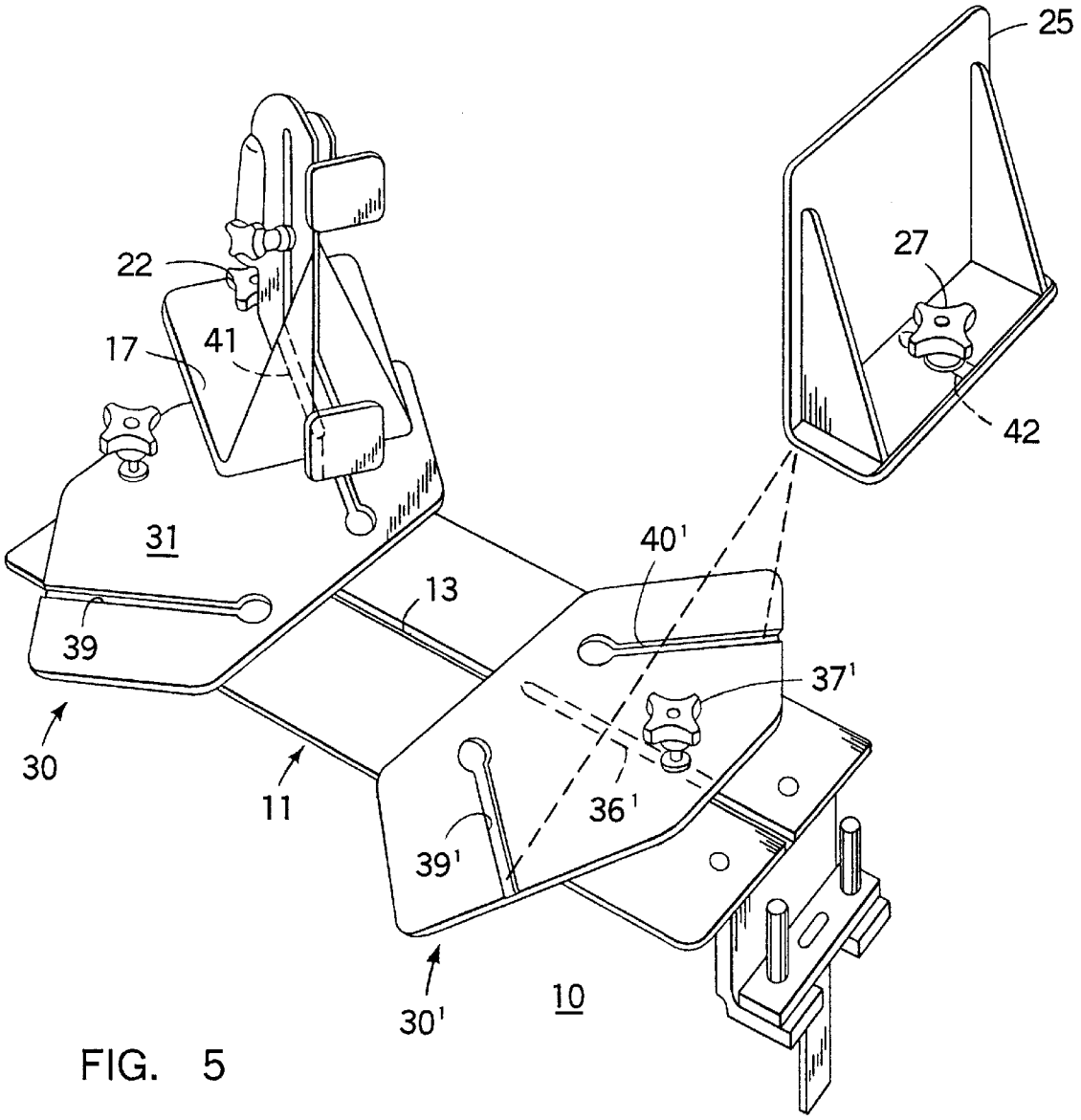
FIG. 5 is a top perspective view of two hyperflexion plates attached to the universal lateral positioner of FIG. 1 with the anterior and posterior position plates of the universal lateral positioner of FIG. 1 in isometric projection.
Figure 6:
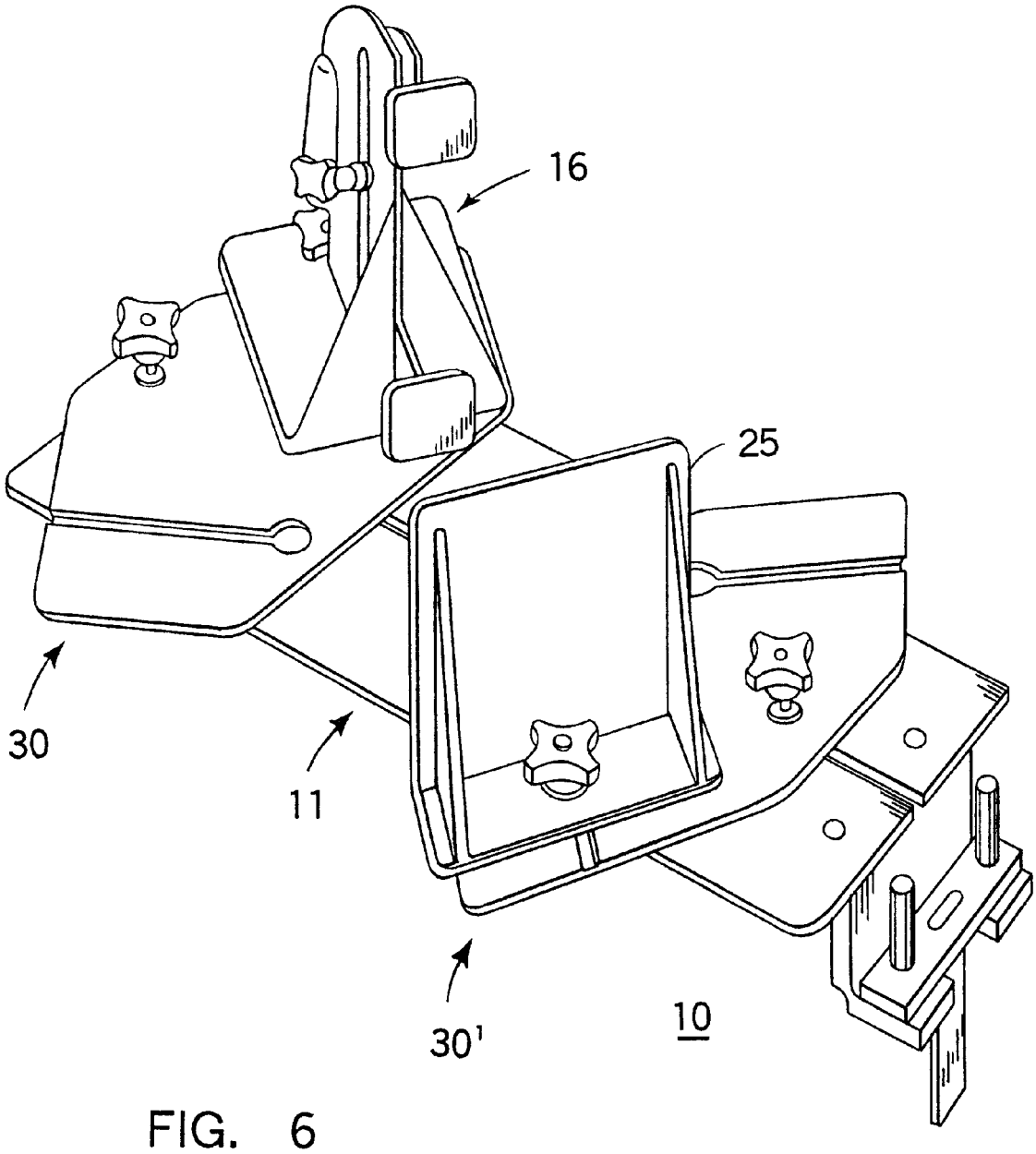
FIG. 6 is a top perspective view of the anterior and posterior position plates of the universal lateral positioner plate of FIG. 1 attached to the two hyperflexion plates shown in FIG. 5.

In the arrangement of the universal lateral positioner 10 shown in FIG. 5, the first hyperflexion plate 30 is shown positioned on the support plate 11 with the anterior support assembly 16 in position thereon as shown in FIG. 4. A second hyperflexion plate 30' is arranged on the support plate 11 by insertion of the second rail 36' within the track 13 and adjusting the knob 37' accordingly. The posterior support plate 25 can optionally be positioned on the second hyperflexion plate 30' by insertion of the rail 42 on the posterior support plate within either of the second tracks 39', 40' on the second hyperflexion plate and adjusting the knob 27. In the manner described with the posterior support plate 25 directly attached to the to support plate 11, and the anterior support plate 16 attached to the hyperflexion plate 30, the anterior support plate 16 can be directly attached to the support plate 11 and the posterior support plate 25 can be attached to the second hyperflexion plate 30' as shown in FIG. 6, if so desired. It is believed that the arrangement of the anterior and posterior plates on first and second hyperflexion plates provides the greatest variation in body positioning heretofore attainable.

A body positioning arrangement for hip treatment and surgery has herein been described as including a first or second hyperflexion plate attached to a standard universal lateral positioner for increased flexion of the hip.

What is claimed is:

1. A hyperflexion plate for positioning a patient undergoing hip treatment and hip surgery comprising:

a planar plate having a hyperflexion plate rail extending from a bottom surface thereof for insertion of said hyperflexion plate rail within a surgical support plate track formed in a surgical support plate adapted to be secured to an operating table;

a first slot formed on a top surface of said planar plate, said first slot extending at a first angle from said hyperflexion plate rail, said first slot being arranged for receiving a surgical support rail and allowing said surgical support plate to extend in a direction of said first angle; and a second slot formed on a top surface of said planar plate, said second slot extending at a second angle from said hyperflexion plate rail, said second slot being arranged for receiving said surgical support rail and allowing said surgical support plate to extend in a direction of said second angle.

2. The hyperflexion plate of claim 1 wherein said first angle is equal to or greater than 45°.

3. The hyperflexion plate of claim 1 wherein said second angle is equal to or greater than 45°.

4. The hyperflexion plate of claim 1 including 2 knob having a threaded stem, said threaded stem being adapted for reception within a threaded aperture formed within said surgical support plate, when said hyperflexion plate is positioned on said surgical support plate.

5. The hyperflexion plate of claim 1 wherein said planar plate comprises aluminum.

6. The hyperflexion plate of claim 5 wherein said planar plate includes a layer of acetal homopolymer arranged on said bottom surface thereof.

7. A universal lateral positioner plate for hip surgery and treatment comprising:

a support plate having means for attaching to an operating table and having a grooved track formed within said support plate;

an anterior support assembly including first and second anterior pressure plates extending therefrom, said first plate being positioned over said second plate, said anterior support assembly having a front rail extending from a bottom surface thereof, said front rail being received within said track for allowing transport of said anterior support assembly in a first direction parallel to said support plate;

a posterior support assembly including a posterior pressure plate extending therefrom, said posterior support assembly having a rear rail extending from a bottom surface thereof, said rear rail being received within said track for allowing transport of said posterior support assembly in said first direction parallel to said support plate;

a first knob on said anterior support assembly having a first threaded stem extending therethrough for fastening said anterior support assembly to said support plate and a a second knob on said posterior support assembly having a second threaded stem extending therethrough for fastening said posterior support assembly to said support plate; and a hyperflexion plate for positioning a patient undergoing hip treatment and hip surgery, said hyperflexion plate including a planar plate having a hyperflexion plate rail extending from a bottom surface thereof for insertion of said hyperflexion plate rail within a surgical support plate track formed in a surgical support plate adapted to be secured to an operating table, and a first slot formed on a top surface of said planar plate, said first slot extending at a first angle from said hyperflexion plate rail and allowing said surgical support plate to extend in a direction of said first angle.

8. The universal lateral positioner plate of claim 7 wherein said hyperflexion plate includes a second slot formed on a top surface of said planar plate, said second slot extending at a second angle from said hyperflexion plate rail, said second slot being arranged for receiving a surgical support rail and allowing said surgical support plate to extend in a direction of said second angle.

9. The universal lateral positioner plate of claim 8 wherein said first angle is equal to or greater than 45°.

10. The universal lateral positioner plate of claim 8 wherein said second angle is equal to or greater than 45°.

11. The universal lateral positioner plate of claim 8 including a knob having a threaded stem, said threaded stem being adapted for reception within a threaded aperture formed within said surgical support plate, when said hyperflexion plate is positioned on said surgical support plate.

12. The universal lateral positioner plate of claim 8 wherein said planar plate comprises aluminum.

13. The universal lateral positioner plate of claim 8 wherein said planar plate includes a layer of acetal homopolymer arranged on said bottom surface thereof.

14. The universal lateral positioner plate of claim 8 wherein said first threaded stem further extends through said assembly support plate for fastening said hyperflexion plate and said anterior support assembly to said support plate.

15. The universal lateral positioner plate of claim 8 wherein said second threaded stem further extends through said support plate for fastening said hyperflexion plate and said posterior support assembly to said support plate.

16. The universal lateral positioner plate of claim 7 including a second hyperflexion plate, said second hyperflexion plate including a second planar plate having a second hyperflexion plate rail extending from a bottom thereof for insertion of said second hyperflexion plate rail within said surgical support plate track formed in said surgical support plate.

* * * * *